United States Patent [19]

Oostvogels

[11] 4,266,456

[45] May 12, 1981

[54] DRIVE MECHANISM FOR THE RECIPROCATING MEAT SUPPORTING CARRIAGE OF A MEAT SLICING MACHINE

[75] Inventor: Johannes M. Oostvogels, Delft, Netherlands

[73] Assignee: Maatschappij van Berkel's Patent N.V., Leidschendam, Netherlands

[21] Appl. No.: 101,881

[22] Filed: Dec. 10, 1979

[30] Foreign Application Priority Data

Dec. 22, 1978 [DE] Fed. Rep. of Germany ..... 2855601

[51] Int. Cl.[3] ..... B26D 4/30

[52] U.S. Cl. ..... 83/731; 83/435.1; 74/37

[58] Field of Search ..... 83/435.1, 435.2, 703, 83/707, 713, 730, 731; 74/37

[56] References Cited

U.S. PATENT DOCUMENTS

| | | | |
|---|---|---|---|
| 1,947,897 | 2/1934 | Campbell | 83/707 |
| 2,528,286 | 10/1950 | Pianta et al. | 74/37 |
| 2,663,341 | 12/1953 | Grove | 74/37 X |
| 3,741,374 | 6/1973 | Hufford | 74/37 X |

*Primary Examiner*—Frank T. Yost

*Assistant Examiner*—Robert P. Olszewski

*Attorney, Agent, or Firm*—Lloyd L. Zickert

[57] ABSTRACT

A drive mechanism for the reciprocating meat supporting carriage of a meat slicing machine wherein the carriage supports the meat product to be sliced and moves the meat product relative to a power driven knife, and which includes an endless belt trained over longitudinally spaced apart pulleys, thereby defining upper and lower horizontal belt runs extending between the pulleys, a drive member connected along the belt and having a driving lug mounted intermediate the ends thereof, the driving lug slidably engaging a drive slot formed in a driven bar extending from the carriage, the slot extending perpendicular to the direction of movement of the carriage, and the ends of the drive member being connected to the belt such that the path of the driving lug during the time the connected ends of the drive member traverse the pulleys follows a path substantially longer than the path of either connected end of the drive member, whereby the deceleration and acceleration forces of the driving lug are substantially less than those of the connected ends of the drive member.

10 Claims, 9 Drawing Figures

FIG. 3
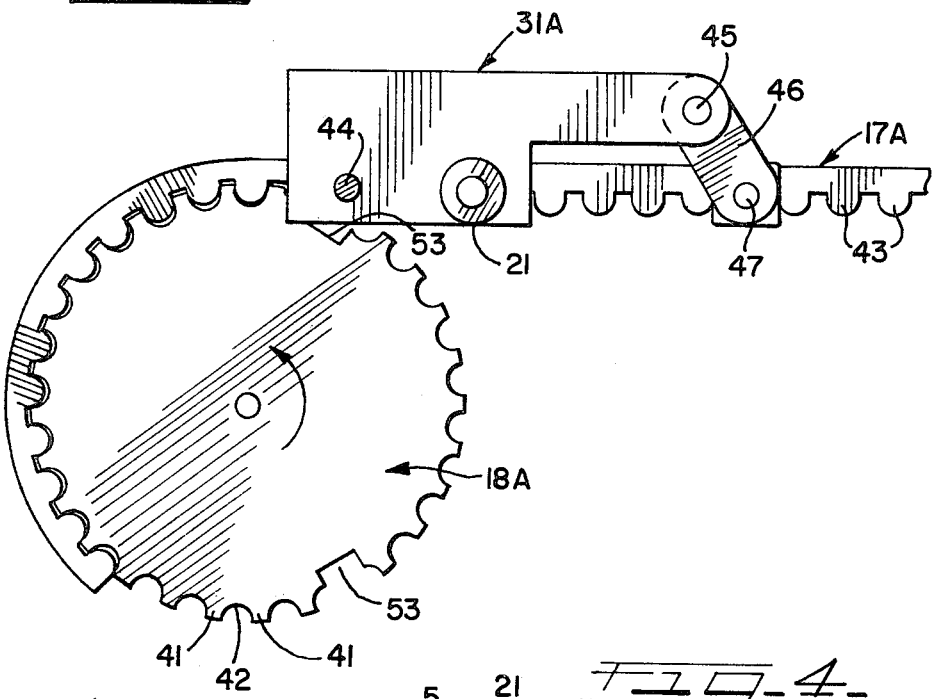
FIG. 4
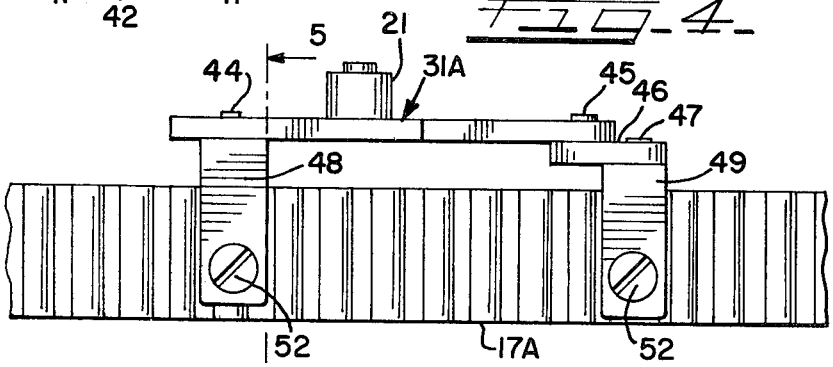
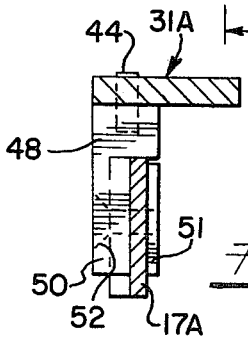
FIG. 5

DRIVE MECHANISM FOR THE RECIPROCATING MEAT SUPPORTING CARRIAGE OF A MEAT SLICING MACHINE

BACKGROUND OF THE INVENTION

This invention relates in general to a driving mechanism for the reciprocating carriage of a meat slicing machine, and more particularly to an improved drive mechanism capable of decreasing the deceleration and acceleration forces applied to the carriage at the ends of the slicing and return strokes of the carriage to thereby reduce the speed and inertia forces occurring during the driving of the carriage.

Heretofore, it has been well known to provide a drive mechanism for the carriage of a meat slicing machine on which the meat product to be sliced is reciprocably driven toward and away from a power driven meat slicing knife in a meat slicing machine. Such a machine typically includes a rotary driven circular meat slicing knife with the meat supporting carriage movable along a straight horizontal line toward and away from the knife through slicing and return strokes or cycles. It has also been known that the drive mechanism may be constructed by having an endless flexible belt trained over longitudinally spaced apart pulleys to define upper and lower horizontally extending belt runs or reaches between the pulleys and extending generally parallel to the direction of movement of the carriage. Such a belt then has mounted thereon a drive lug which follows the path of the belt over the horizontal runs and the circumferences of the pulleys and which drive lug engages in slidable fashion a drive slot formed in a driven bar connected to the carriage such that the slot extends generally perpendicular to the direction of carriage movement. One of the pulleys is power driven which then transmits the power to the endless belt. Such a drive for the pulleys may consist of a motor and a reduction gear assembly. For compactness and economic reasons, the pulleys have a small diameter, thereby requiring the pulleys to traverse a large number of revolutions for one complete revolution of the endless belt. Since the drive lug follows the endless belt, it is subjected, as is the carriage and driven bar extending therefrom, to high deceleration and acceleration forces when the drive lug traverses the pulleys. These deceleration and acceleration forces or speed variations cause undesirable inertia forces to be transmitted to the moving parts of the machine which have an adverse affect on the life of the machine. In order to avoid these undesirable inertia forces, it has been heretofore necessary to employ more complex and therefore more expensive drive mechanisms or to use this type of drive mechanism with oversized pulleys which require a great deal of space and are otherwise more satisfactory for driving the endless belt.

SUMMARY OF THE INVENTION

The drive mechanism of the present invention is of the endless-belt type and is a substantial improvement over heretofore known endless-belt type drive mechanisms in that only moderate increases in speed and inertia forces will occur during the reciprocal driving motion of the carriage, while at the same time utilizing pulleys of relatively small diameter for compactness and economic purposes. More specifically, the driving lug is mounted intermediate the ends of a drive member or bar having its opposite ends connected to the belt and the effective length of which varies during the traversing of the connected ends of the drive member over the pulleys to cause the driving lug to move through a substantially longer path which results in substantial reduction of the speed of the driving lug at the ends of the slicing and return strokes as well as the inertia forces applied to the moving parts of the machine. Accordingly, the life of the machine is substantially enhanced. The effective length of the drive member or bar connected to the endless belt varies as the points of connection are closer together during the traversing of the connection points on the pulleys than when the connection points are traversing the upper and lower horizontal runs of the belt. Further, the multiple connections of the driven member on the belt apply forces to a longer portion of the belt. It can be appreciated that since the points of connection of the driving member or bar are spaced apart along the belt, while the leading connection point commences traverse of the pulley, the trailing connection point is still along a horizontal run of the belt, thereby producing a compensating effect on the deceleration and acceleration forces of the driving lug carried by the drive member, so that the maximum deceleration and acceleration values are distributed over a longer portion of the carriage movement depending upon the length of the drive member.

Accordingly, the drive mechanism of the invention reduces the forces of deceleration and acceleration not heretofore possible with pulleys of the same size. This allows the maintenance of a compact meat slicing machine having a materially improved life by reducing undesirable inertia forces. This is possible by the variable effective length of the drive member which ultimately changes relative the connection points of the drive member to the endless belt as the drive member connection points traverse the curved sections of the pulleys. It will be appreciated that while the connection points of the drive member are both on the curved portion of a pulley, the section of the endless belt between the connecting points of the drive member forms the curvature of the pulley, while the drive member travels as the secant to the diameter of the pulley. Thus, the effective length of the drive member decreases in the areas of the curved portions of the pulleys.

In one embodiment of the invention the effective length of the drive member is varied by connecting one end of the drive member to a fixed point on the belt and the other end by means of a sliding engagement with a point on the belt such as by a pin and slot connection. Thus, the effective length of the drive member changes by the sliding adjustments of the pin-slot connection as the connections to the belt traverse the pulleys. In another embodiment one end of the drive member is connected to a fixed point on the belt, while the other end is pivotally connected to a link which in turn is pivotally connected to a point on the belt, whereby the effective length of the drive member is changed by buckling of the drive member through the link connection. In still another embodiment the drive member is in the form of a telescoping linkage, one end of which is connected to a fixed point on the belt and the other end of which is connected to a fixed point on the belt wherein one part of the drive member telescopes with respect to the other part to change the effective length thereof. It will be appreciated that other types of drive members may be also employed wherein the effective length of the drive member can be changed as the points of connection to the endless belt traverse the pulleys.

It is therefore an object of the present invention to provide a new and improved drive mechanism of the endless belt type for a meat slicing machine wherein the inertia forces of the reciprocably driven carriage are substantially reduced to enhance the life of the machine and otherwise improve the efficiency of the machine.

Another object of this invention is in the provision of an improved endless-belt type drive mechanism for reciprocably driving a meat supporting carriage relative a slicing knife on a meat slicing machine, wherein a drive member having a driving lug engaging a slide bar connected to the carriage mounts the driving lug on the endless belt by means of a drive member having the driving lug intermediate its ends and the ends connected to the belt so that the effective length of the drive member varies during the traversing of the pulleys by the connecting points of the drive member.

BRIEF DESCRIPTION OF THE DRAWINGS

Other objects, features and advantages of the invention will be apparent from the following detailed disclosure, taken in conjunction with the accompanying sheets of drawings, wherein like reference numerals refer to like parts, in which:

FIG. 3 is a fragmentary side elevational view of a modified drive mechanism according to the present invention;

FIG. 4 is a bottom plan view of the belt and drive member shown in FIG. 3;

FIG. 5 is a detailed sectional view taken substantially along line 5—5 of FIG. 4;

DETAILED DESCRIPTION OF THE PREFERRED EMBODIMENTS

Figure 1:
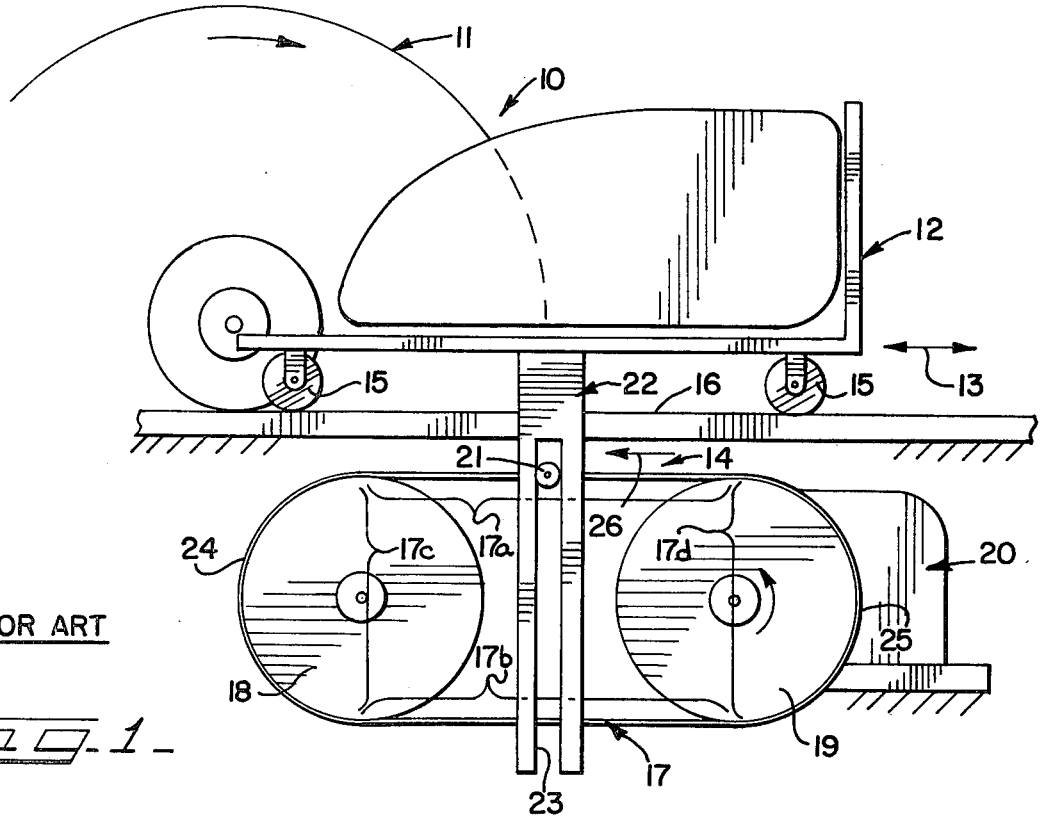
PRIOR ART FIG. 1
FIG. 1 is a generally diagrammatic side elevational view of a prior art meat slicing machine having an endless-belt type drive mechanism for the meat supporting carriage.

Referring now to the drawings and particularly to the prior art illustration of an endless-belt type drive mechanism for a meat slicing machine of FIG. 1, the slicing machine is generally designated by the numeral 10 and includes generally a rotary driven circular slicing knife 11, a meat supporting carriage 12 mounted for reciprocal movement toward and away from the slicing knife 11 in the direction of the arrow 13, and an endless-belt type drive mechanism 14 for reciprocably driving the carriage 12. Thus, a meat product to be sliced is supported on the carriage 12 and driven reciprocably by the drive mechanism 14 toward and away from the slicing knife 11 through slicing and return strokes to continually slice the meat product into a plurality of slices. The carriage 12 includes supporting wheels 15 riding on a flat platform 16 which extends horizontally for purposes of guiding the carriage along a straight line of movement. The drive mechanism 14 includes an endless flexible belt 17 trained over longitudinally spaced apart rotatable pulleys 18 and 19, all of which is supported below the carriage 12 in a suitable fashion. It will be appreciated the pulleys 18 and 19 are of the same size and are suitably mounted for rotation on shafts or the like. Further, it will be appreciated that one of the pulleys will be power driven, and in this respect a combination drive motor and gear box 20 drives the pulley 19. The endless belt 17 provides upper and lower horizontal belt runs or reaches 17*a* and 17*b* extending between the pulleys and arcuate or curved belt runs or reaches 17*c* and 17*d* over the pulleys 18 and 19 respectively. A driving lug 21 is mounted on the endless belt and, as illustrated, extends laterally therefrom and is in sliding engagement with a driven bar 22 extending from beneath the carriage 12. More particularly, a drive slot 23 is provided in the drive bar 22 and in which the driving lug 21 slidably engages. This drive slot extends generally perpendicularly to the horizontal directional movement of the carriage 12. The driving lug 21 is in the form of a roller and as it follows the path of the endless belt 17 it will cause the carriage to reciprocate, and it will be appreciated that the direction of movement of the lug changes at the opposite apex points 24 and 25 at the pulleys 18 and 19 respectively. Further, as the belt 17 moves in the direction of the arrow 26 causing the driving lug 21 to move away from the pulley 19 and toward the pulley 18, the speed of the carriage will commence to decrease as the lug commences traversing the pulley 18 until it passes the point 24, after which the speed of the lug will commence to increase until it reaches full speed as the lug leaves the curved area of the pulley 18. Similarly, the speed of the carriage is reduced when the lug 21 is on the lower belt run and during the time it traverses the pulley 19 to the point 25, after which it then commences to increase until it reaches full speed as it leaves the pulley 19. Thus, the carriage is subjected to deceleration and acceleration forces at the ends of the slicing and return strokes and during the time the driving lug 21 traverses the pulleys 18 and 19. It will be appreciated that as the diameter of the pulleys 18 and 19 is decreased, there is a corresponding increase in the speed variation in the direction of drive of the carriage 12 which will adversely affect the driven components of the machine.

Figure 2:
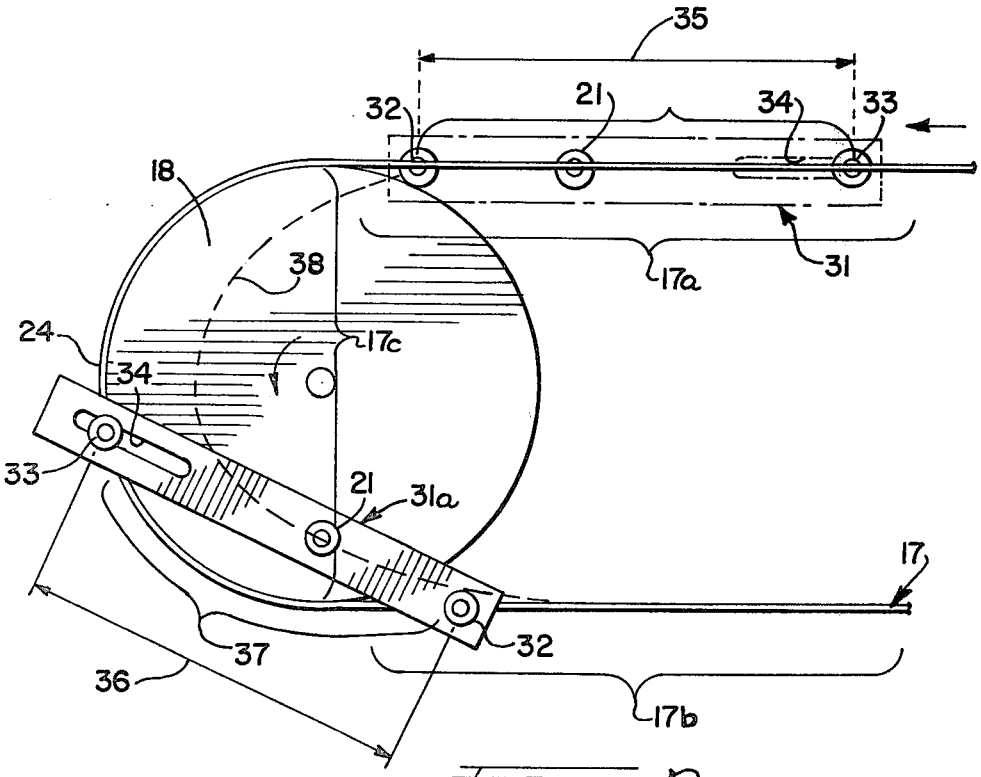
FIG. 2 is an enlarged fragmentary side elevational view of one embodiment of the drive mechanism according to the present invention for illustrating the principle of construction and operation thereof.

One embodiment of the present invention is illustrated in FIG. 2, and for purposes of comparison, like numerals are applied to like elements. The drive mechanism of the invention differs from that of the prior art and that illustrated in FIG. 1 in that the driving lug 21 is not mounted directly on the endless belt 17 but is mounted on a drive member or bar 31 which is elongated and is itself connected at opposite ends to the endless belt 17. In the embodiment of FIG. 2, the leading end of the drive member 31 is pivotally connected to the belt at 32, while the trailing end of the drive member is slidably connected to a pin 33 extending from the belt by means of a slot 34 formed in the drive member 31 and slidably engaging the pin 33. Thus, the drive member 31 is connected at its leading end to a fixed point on the belt, while at its trailing end to a point that allows movement relative the drive member and which thereby, when the drive member traverses the pulley 18, changes or varies its effective length. The effective length of the drive member 31, when the drive member connections are traversing the horizontal run 17*a*, is indicated by the dimension 35 and is illustrated as being somewhat shorter when at least one of the connections of the drive member is on the pulley 18 by the dimension 36. During the entire time the connection of the drive member at the leading edge or the trailing edge traverses the curvature of the pulley 18 as depicted by 17*c*, the effective length of the drive member is shorter than when the drive member is aligned only with a horizontal run of the belt. The position of the drive member at 31*a* is such that the trailing connection of the drive member to the belt is still traversing the curved portion of the pulley, while the leading connection 32 is already on the lower horizontal run 17*b* of the belt and is beyond the area of acceleration which extends between the point 24 and the bottom point of the pulley. The trailing connection point of the drive member is still subject to the variations in the speed at the curved portion of the pulley. This differential velocity between the points of connection 32 and 33 of the drive member transmits a mutually compensating effect on the driving lug 21 carried by the drive member.

It will therefore be appreciated that as long as the drive member connections 32 and 33 are both along the horizontal belt runs 17*a* and 17*b*, at which time the lug 21 is also generally aligned with the belt runs, the effective length of the drive member is the same length as the belt section 35. However, as soon as one or both points of connection of the drive member 31 enter the area of the curved portion of the pulley 18, such as the belt section 37, it will be seen that the belt section 37 forms a partial circular arc, while the drive member 31*a* makes a partial secant thereto. Thus, the drive member 31, while being a rigid member, shortens its effective length automatically compared to the fully extended length 35 when the drive member traverses the pulley 18. Likewise, it would do the same when it traverses the pulley 19, which is not shown in FIG. 2. As the drive member 31 traverses the curvature of the pulley 18, it will be appreciated that the path of the driving lug 21 will be along the dotted line 38 which is different from the path of the endless belt and which is longer than the path of either connection 32 or 33 as it traverses the curved portion 17*c* of the pulley 18. Accordingly, it will be appreciated that the deceleration and acceleration forces applied by the driving lug 21 to the carriage 12 will be substantially less than those forces applied to the carriage by the prior art drive mechanism of FIG. 1.

The embodiment illustrated in FIGS. 3, 4 and 5 differs from the embodiment in FIG. 2 essentially in the construction of the drive member on which the driving lug 21 is mounted. Additionally, the belt which is generally designated by the numeral 17A is structured differently in order to accommodate differently structured pulleys, only one of which is shown and generally designated by the numeral 18A. It will be appreciated, as shown in the drawings, that the pulley 18A includes a plurality of teeth 41 defining therebetween each pair of indent 42. The face of the belt 17A engaging the pulley includes teeth or splines or detents 43 which mate with the indents 42 and are spaced apart the same distance as the indents on pulley 18A. Essentially, the engaging surfaces of the belt and pulleys have mating or interengaging teeth to prevent slippage therebetween. The drive member is generally indicated by the numeral 31A and is pivoted at its leading end on a pin 44 extending from an edge of the belt at its trailing end on a pin 45 having also connected thereto a connecting link 46 which is in turn pivoted on its other end to a pin 47 mounted on the side of the belt 17A. When the drive member 31A is situated along the upper or lower horizontal run of the endless belt, it will take the position shown in FIG. 3 wherein the trailing end of the drive member is offset from the belt because of the connecting link 46 being interposed between the drive member and the belt. As seen particularly in FIG. 4, the pin 44 is carried by an arm 48, while the pin 47 is carried by an arm 49. The arms 48 and 49 include portions 50 and 51 which embrace both sides of the belt 17A and one edge of the belt. The one portion 50 is formed to receive a tooth 43, while the other portion 51 is formed to engage the upper surface of the belt. A screw or fastener 52 is provided for extending through openings in the portions 50 and 51 in the belt 17A and for fastening securely the arms 48 and 49 to the belt and likewise the drive member 31A securely to the belt. It will be noted that the driving lug 21 is essentially aligned with the belt when the drive member is along a horizontal run, as shown in FIG. 3.

The arms 48 and 49 protrude or extend from the tooth side of the belt, and, accordingly, recesses 53 are formed in the pulley 18A to accommodate these arms as the arms engage the circumferential face of the pulleys.

The operation of the embodiment of FIGS. 3, 4 and 5, as far as defining the path of the driving lug 21, is essentially the same as the embodiment of FIG. 2 in that the effective length of the drive member will change as it traverses the pulley 18A. The leading end of the drive member 31A is pivoted at a fixed point to the belt, while the trailing end of the drive member is movable by virtue of the interconnection to the belt with the connecting link 46 which is pivotally connected at its opposite ends to the belt and the drive member.

Figure 9:
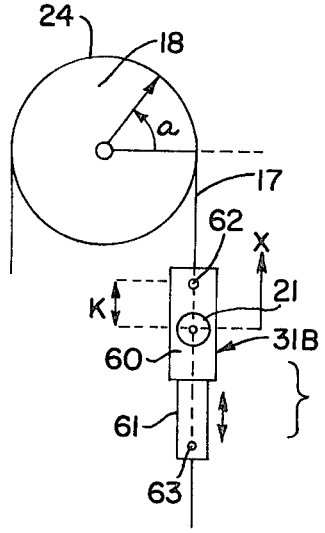
FIG. 9 is a diagrammatic side elevational view of a modified drive mechanism according to the invention and which was used for developing the force curve for the invention plotted in FIG. 8.
Figure 8:
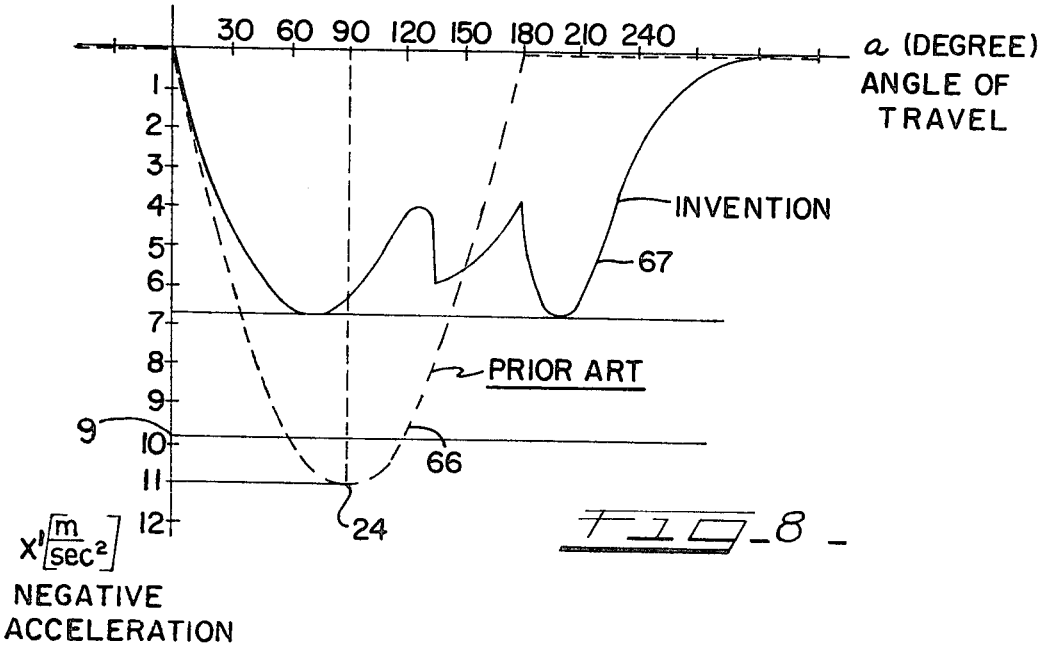
FIG. 8 is a graphical comparison of the deceleration and acceleration forces of the prior art and the invention.

Reference will now be made to FIGS. 8 and 9 to further show that the driving lug on the drive member according to the invention is subjected to considerably reduced speed in the area of the return points 24 and 25 as compared to the prior art structure of FIG. 1 during movement of the carriage 12 in the directions of the double-headed arrow 13. Only the relevant part of the drive mechanism is shown in this experimental arrangement and particularly only the drive member is illustrated which is generally identifed by the numeral 31B. This drive member is in the form of a telescoping linkage including a leading section 60 and a trailing section 61 telescopically connected to the leading section 60. The leading section 60 is pivotally connected to a pin 62 carried by the belt 17, while the trailing section 61 is pivotally connected to a pin 63 carried by the belt 17. It will be appreciated that the effective length of the drive members 31B is at its maximum during movement of the drive member with both connection points thereof being along the horizontal belt runs and that the effective length will vary during movement of the drive member when one or both of the connection points to the belt traverse the pulley 18. Likewise, the path of the driving lug 21 during traverse of the pulley 18 by the drive member will be approximately the same as the path 38 illustrated in the first embodiment shown in FIG. 2.

With reference to the graphical illustration in FIG. 8, the angle of travel a in degrees of the pulley 18 is plotted along the abscissa of the graph, while the deceleration and acceleration of the driving lug is plotted along the ordinate in m/sec$^2$.

The driving lug 21 is spaced at a fixed preselected distance K from the leading drive member connection 62 and the path of the lug is represented in the direction x. With reference to FIG. 8, the negative accelerations or decelerations x' are plotted along the ordinate.

For the purpose of illustrating the operation of the prior art embodiment of FIG. 1, the distance K is reduced to zero wherein the position of the driving lug 21 is coextensive with the leading drive member connection 62. The resulting forces illustrated by the dash line 66 in FIG. 8 and also indicated as prior art, as expected, produces a sinusoidal acceleration curve during the traversing of 180 degrees of the pulley 18 which reaches its peak at point 24 at 90 degrees and which produces an acceleration in excess of the acceleration due to gravity g and to a value of 11 m/sec$^2$.

With respect to the operation of the present invention where the distance between the driving lug 21 and the leading fixed connection 62 is K and, for example, which may be a distance of 20 mm results in an acceleration curve along the angular path of travel by the pulley 18 as shown by the solid line 67 in FIG. 8 and also identified as the invention. The acceleration forces on the driving lug 21 are now determined by the combined effect of the two connecting points 62 and 63 of the drive member 31. These accelerations are spread over a much wider angle because a correspondingly larger angle of travel is necessary before the trailing connecting point 63 clears the pulley 18. Accordingly, the maximum values for the negative acceleration and acceleration are substantially reduced, whereby the peaks thereof are well below the acceleration due to gravity and the peaks do not even reach 7 m/sec$^2$. This represents an improvement of 38 percent over the prior art. Further, it can be seen by the curve 67 that the various points of entry and exit of the connecting points 62 and 63 of the drive member 31B produce several peaks and valleys concentrated in a comparatively narrow band of negative acceleration. This illustrates a substantial reduction and equalization of the acceleration forces, all of which will further result in a quieter and smoother drive mechanism having less wear, thereby giving a longer life to the components of the drive mechanism.

It will be recognized that by modifying the length of the drive member on any of the embodiments such as the distance between the connecting points to the endless belt, the operating characteristics of the drive member will likewise be changed and in certain instances an even flatter and lower curve than curve 67 could be produced.

Figure 6:
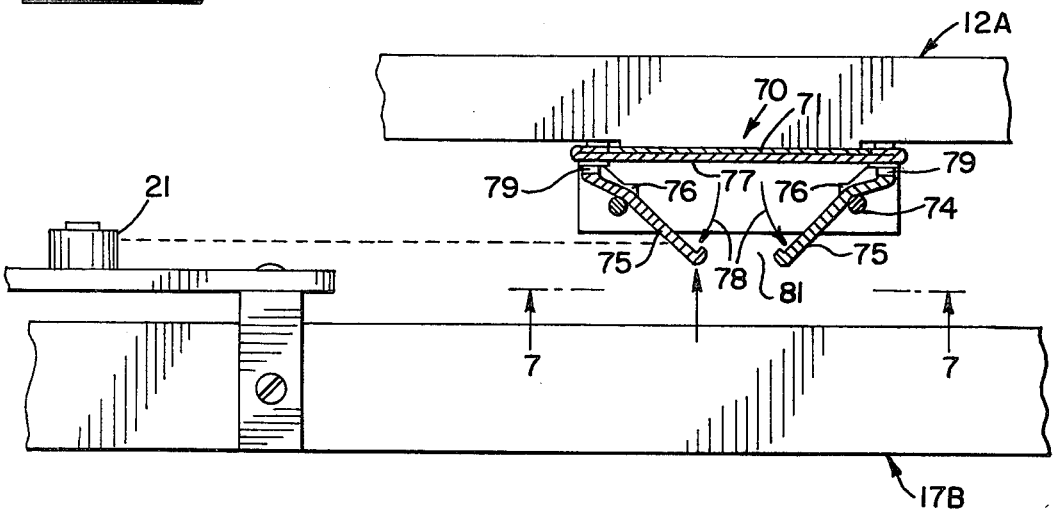
FIG. 6 is a fragmentary side elevational view of a further modification of the invention and particularly of a modified coupling structure between the driving lug and the carriage and with respect to the carriage taken substantially along line 6—6 of FIG. 7.
Figure 7:
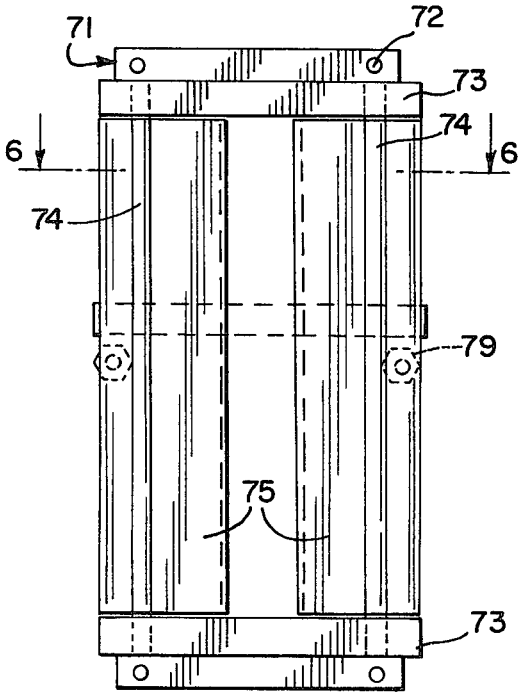
FIG. 7 is a bottom plan view of the coupling structure shown in FIG. 6 and taken substantially along line 7—7 therein.

The embodiment of FIGS. 6 and 7 concerns the coupling of the meat supporting carriage to the driving lug 21. The carriage in this embodiment is generally indicated by the numeral 12A and includes a coupler 70 that allows easy connection and disconnection of the carriage to the driving lug 21. The coupler includes a base plate 71 fixed to the carriage platform by means of screws or the like extending through holes 72. The base plate extends parallel to the endless belt 17B. The base plate 71 includes transversely spaced apart bearing supports 73 which bearingly support pivotal shafts 74. Spring-loaded plates 75 are mounted on the shafts 74 and are spring loaded in the direction of the arrows shown in FIG. 6 by ends 76 of a leaf spring 77. Thus, the plates 75 are biased or loaded to swing in the direction of the arrows 78 but may swing upwardly or against the direction of the arrows and against the spring force of the leaf spring 77. The outward swinging movement of the plates 75 may be adjusted by adjustable stops 79 which are in the form of nut and bolt assemblies.

The lower edges of the plates 75 define therebetween an opening 81 into which the driving lug 21 may be received when the carriage is coupled to the driving lug. Since the plates are at an incline, movement of the driving lug relative the coupler 70 where they move toward each other will cause camming of one or the other of the plates upward until the driving lug is within the opening 81, after which the cammed plate will drop and lock the lug to the carriage. Similarly, disconnection of the carriage from the driving lug can easily be accomplished by depressing one or the other of the plates 75 and moving the carriage away from the driving lug. Thus, it can be appreciated that quick and easy coupling and decoupling of the carriage to the driving lug can be accomplished by the coupler 70.

From the foregoing, it will be readily appreciated that the present invention is capable of producing favorable deceleration and acceleration forces in the driving of the carriage by providing a drive member capable of variable effective length during traverse of the pulleys by the belt onto which the drive member is mounted. Further, the variable length may be achieved by any known structural materials and could even be made to vary the effective length by use of a drive member that is deformable along its length.

It will be understood that modifications and variations may be effected without departing from the scope of the novel concepts of the present invention, but it is understood that this application is to be limited only by the scope of the appended claims.

The invention is hereby claimed as follows:

1. In a meat slicing machine including a power driven slicing knife, a reciprocably mounted carriage for supporting meat to be sliced, a driven bar connected to said carriage having a drive slot extending perpendicular to the movement of said carriage, and means engaging said drive slot for reciprocably driving said carriage relative said knife through cutting and return strokes, the improvement in said reciprocable drive means which includes an endless belt trained over longitudinally spaced apart pulleys defining upper and lower horizontal belt runs between the pulleys, means driving at least one of said pulleys, a drive member connected to said belt and having a driving lug mounted intermediate the ends thereof and in substantial alignment with said belt during movement along the horizontal belt runs, said lug slidably engaging said drive slot, and means connecting the ends of said drive member to said belt such that while the connected ends of the drive member traverse a pulley the path of the lug between the horizontal runs is substantially longer than each path of the connected ends of the drive member thereby decreasing the acceleration of the lug and carriage at the ends of the cutting and return strokes.

2. the reciprocable drive means defined in claim 1, wherein at least one end of the drive member is connected to a fixed point on the belt.

3. The reciprocable drive means defined in claim 2, wherein one end of the drive member is slidably connected to the belt.

4. The reciprocable drive means defined in claim 2, wherein one end of the drive member is connected to the belt by a link pivotally connected at opposite ends to the drive member and the belt.

5. The reciprocable drive means defined in claim 1, wherein said drive member includes two drive member sections telescopically related to each other.

6. The reciprocable drive means defined in claim 1, wherein said drive member includes two pivotally connected drive member sections which buckle transversely relative each other when the drive member traverses the pulleys.

7. The reciprocable drive means defined in claim 1, wherein said belt and said pulleys have means for preventing relative slippage therebetween.

8. The reciprocable drive means defined in claim 7, wherein said means for preventing slippage includes spaced detents on said belt engaging spaced indents on said pulleys.

9. The reciprocable drive means defined in claim 1, wherein said drive slot is defined by movable members that permit quick coupling and uncoupling between the carriage and said driving lug.

10. In a meat slicing machine including a power driven slicing knife, a reciprocably mounted carriage for supporting meat to be sliced, a driven bar connected to said carriage having a drive slot extending perpendicular to the movement of said carriage, and means engaging said drive slot for reciprocably driving said carriage relative said knife through cutting and return strokes, the improvement in said reciprocable drive means which includes an endless belt trained over longitudinally spaced apart pulleys defining upper and lower horizontal belt runs between the pulleys, means driving at least one of said pulleys, a drive member connected to said belt and having a driving lug mounted intermediate the ends thereof and in substantial alignment with said belt during movement along the horizontal belt runs, said lug slidably engaging said drive slot, and means connecting the ends of the drive member to the belt such that the effective length of the drive member is variable between the horizontal runs to cause the lug to traverse a longer path than each path of the connected ends thereby decreasing the acceleration of the lug and carriage at the ends of the cutting and return strokes.

* * * * *